US007520479B1

(12) United States Patent
Conner, Sr.

(10) Patent No.: US 7,520,479 B1
(45) Date of Patent: Apr. 21, 2009

(54) CONTAINER DEVICE FOR A LADDER

(76) Inventor: Michael E. Conner, Sr., 1150 Knight Rd., Pine Hall, NC (US) 27042

( * ) Notice: Subject to any disclaimer, the term of this patent is extended or adjusted under 35 U.S.C. 154(b) by 0 days.

(21) Appl. No.: 11/651,658

(22) Filed: Jan. 10, 2007

(51) Int. Cl.
*E06C 7/14* (2006.01)

(52) U.S. Cl. ..... 248/211; 206/1.9

(58) Field of Classification Search ..... 248/210, 248/211, 238, 311.2; 206/1.8, 1.9; 220/570
See application file for complete search history.

(56) References Cited

U.S. PATENT DOCUMENTS 3,661,351 A * 5/1972 Olsen ..... 248/210
3,738,601 A * 6/1973 Gehringer ..... 248/210
4,036,463 A * 7/1977 Hopkins et al. ..... 248/210
4,403,368 A * 9/1983 Harper ..... 15/257.01
4,765,123 A * 8/1988 Caldwell ..... 53/459
4,893,723 A * 1/1990 Seabolt ..... 220/570
5,052,581 A * 10/1991 Christ et al. ..... 220/570
5,062,607 A * 11/1991 Kisner ..... 248/211
6,076,636 A * 6/2000 Tietge ..... 182/129
7,083,044 B1 * 8/2006 Kilian et al. ..... 3/229
7,143,987 B2 * 12/2006 Salani ..... 248/211
2006/0196999 A1 * 9/2006 Owens et al. ..... 248/210
2006/0226156 A1 * 10/2006 Lundy et al. ..... 220/570

OTHER PUBLICATIONS

U.S. Appl. No. 11/432,601, filed May 11, 2006, Willison, George R.

* cited by examiner

*Primary Examiner*—Ramon O Ramirez
(74) *Attorney, Agent, or Firm*—Williams Mullen; Eric Adcock

(57) ABSTRACT

A container device having a paint receptacle allows a user to easily access paint with a brush while working on a ladder. The container device includes a pair of fixed brackets for attachment to a desired ladder rung and a pivotable bracket to stabilize the container device on a lower ladder rung. The paint receptacle maintains the paint in a convenient manner during use and includes an interior wipe board for removing excess paint from a paint brush and a brush clamp for storing a paint brush when not in use. A lid and handle are also included for tightly sealing any remaining paint therein during transportation and storage. A fabric cover having a series of pockets can be placed on the lower portion of the container device for carrying various painting tools and accessories.

3 Claims, 8 Drawing Sheets

CONTAINER DEVICE FOR A LADDER

FIELD OF THE INVENTION

The invention herein pertains to receptacles and particularly pertains to a paint receptacle for releasable attachment to the rungs of a ladder.

DESCRIPTION OF THE PRIOR ART AND OBJECTIVES OF THE INVENTION

Paint buckets, cans and trays along with other devices have long been used to hold paint during the manual application process. Painting with a brush while standing on a ladder requires a moderate degree of agility and care as the paint container must be secured to prevent spillage. As the ladder is often moved during the painting process special care has to be taken in holding a conventional paint can to prevent spillage. Also, space has to be available for the placement of tools normally employed, such as stirrers, scrapers, putty knives and the like as such tools are frequently used and exchanged with the painter's brush. Fold-out trays on step ladders do not sufficiently secure a typical can of paint. Also, painters' tools are often laden with wet paint thereby presenting a dilemma in maintaining such tools in a manner that is easily accessible.

Therefore, based on the problems and disadvantages of conventional containers and methods used while painting, especially while painting while on a ladder, the present invention was conceived and one of its objectives is to provide a container device for affixing to a ladder having a paint receptacle which will maintain a quantity of paint in a convenient manner.

It is another objective of the present invention to provide a container device which includes a pair of fixed brackets for affixing the container device to a ladder rung and a pivotable bracket for affixing to a lower ladder rung for stabilization of the container device on the ladder rungs.

It is still another objective of the present invention to provide a container device which includes a lid that can be placed on the paint receptacle for providing an air tight sealing any remaining paint therein and maintaining the paint in a fresh condition for later use.

It is yet another objective of the present invention to provide a container device with a paint receptacle which includes a wipe board therein for removing excess paint from a paint brush while painting and a bracket for releasably maintaining a paint brush within the paint receptacle.

It is a further objective of the present invention to provide a cover for a container device which is formed from fabric or other flexible materials and includes pockets for maintaining various painting accessories against the container device.

It is still a further objective of the present invention to provide a container device which includes a handle with locking tabs which can be raised upright to a vertical position to lock the lid in place for ease in transporting the container device having paint therein.

Various other objectives and advantages of the present invention will become apparent to those skilled in the art as a more detailed description is set forth below.

SUMMARY OF THE INVENTION

The aforesaid and other objectives are realized by providing an affordable container device having a paint receptacle therein for receiving a quantity of paint from a standard paint can. The container device is rectangular in shape and has a front wall, a pair of side walls and a rear wall. The container device includes a pair of fixed inverted L-shaped brackets affixed to the top outside of the rear wall for attaching to the rung of a ladder. A third, pivotable bracket for attachment to another or lower ladder rung for stabilization of the container device is affixed at the bottom outside of the rear wall and maintained within a groove provided in the rear wall when not in use. The brackets maintain the container device in a stable position on the ladder to allow a painter positioned on the ladder convenient access to the paint while painting and thereafter the ability to move the ladder with the container device positioned thereon without spillage.

The pivotable bracket includes studs which are positioned on each side of the head of the pivotable bracket and are received in channels formed within the groove to lock the pivotable bracket in an upright dormant position. In use, the pair of fixed brackets are affixed to a ladder rung and the pivotable bracket is rotated outwardly and downward from the groove for engagement with a lower ladder rung. Inside the paint receptacle a wipe board allows the user after saturating a paint brush with paint to wipe any excess paint therefrom. A U-shaped bracket is affixed to the interior side wall of the paint receptacle for supporting the handle of a paint brush during storage. A lid allows any remaining paint in the paint receptacle to be sealed therein to prevent solvent evaporation of the paint and an external handle can be rotated over the lid to lock the lid in place while transporting or during periods of dormancy. Locking tabs on the handle engage slides along each end of the lid to apply pressure to seal the lid in a substantially air tight condition.

A cover formed from a flexible material such as a canvas like fabric can be placed on the container device. The cover includes an elastic band around the top for securing the cover to the container device and exterior pockets on the cover provide space for storage of small tools and paint accessories. A channel is provided in the rear of the cover to allow for access and movement of the pivotable bracket.

DETAILED DESCRIPTION OF THE PREFERRED EMBODIMENT AND OPERATION OF THE INVENTION

Figure 1:
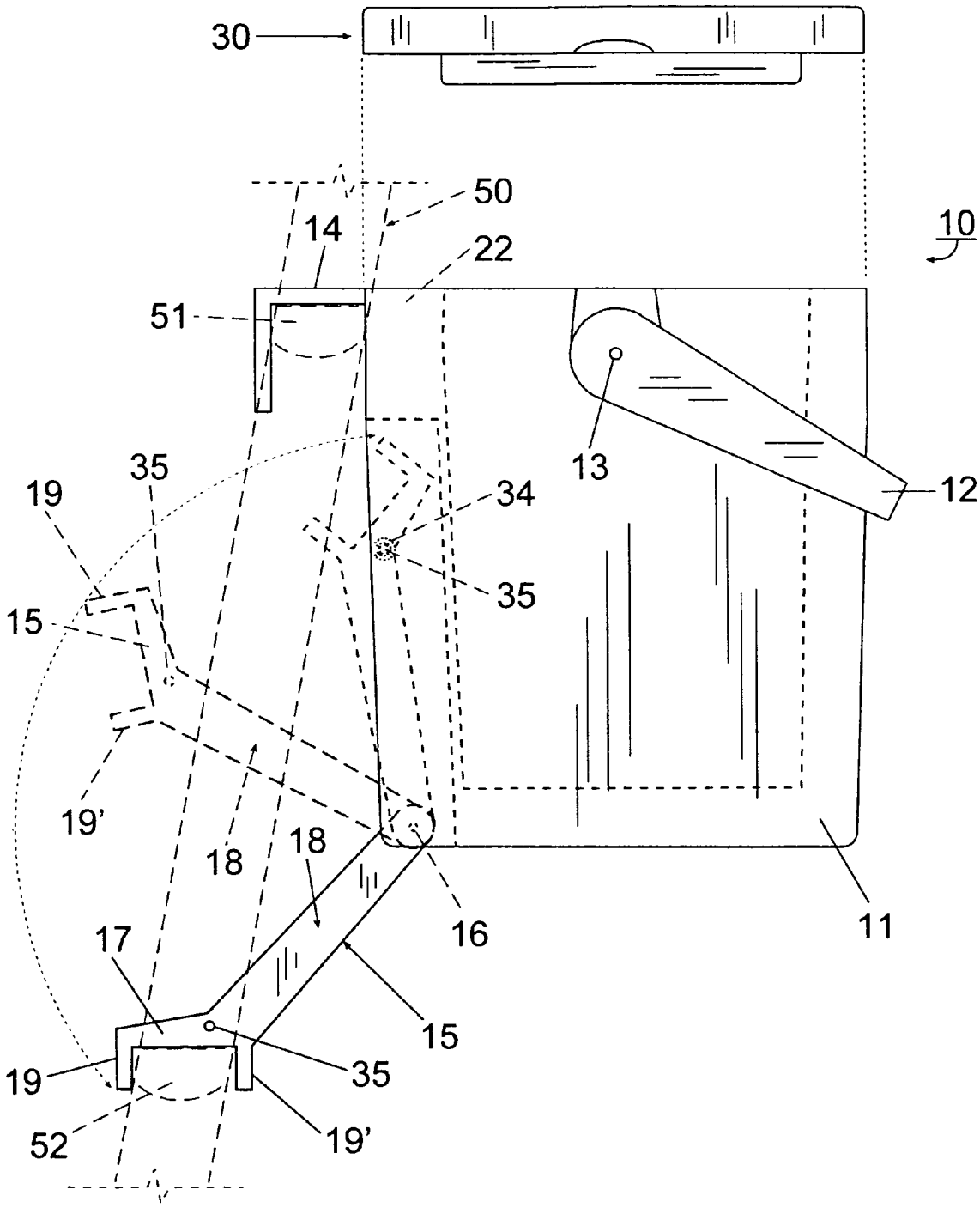
FIG. 1 shows a left side elevational view of the container device of the invention with the lid and cover removed and as affixed to an imaginary ladder with brackets, with movement of the pivotable bracket shown in dotted (imaginary) line fashion.
Figure 2:
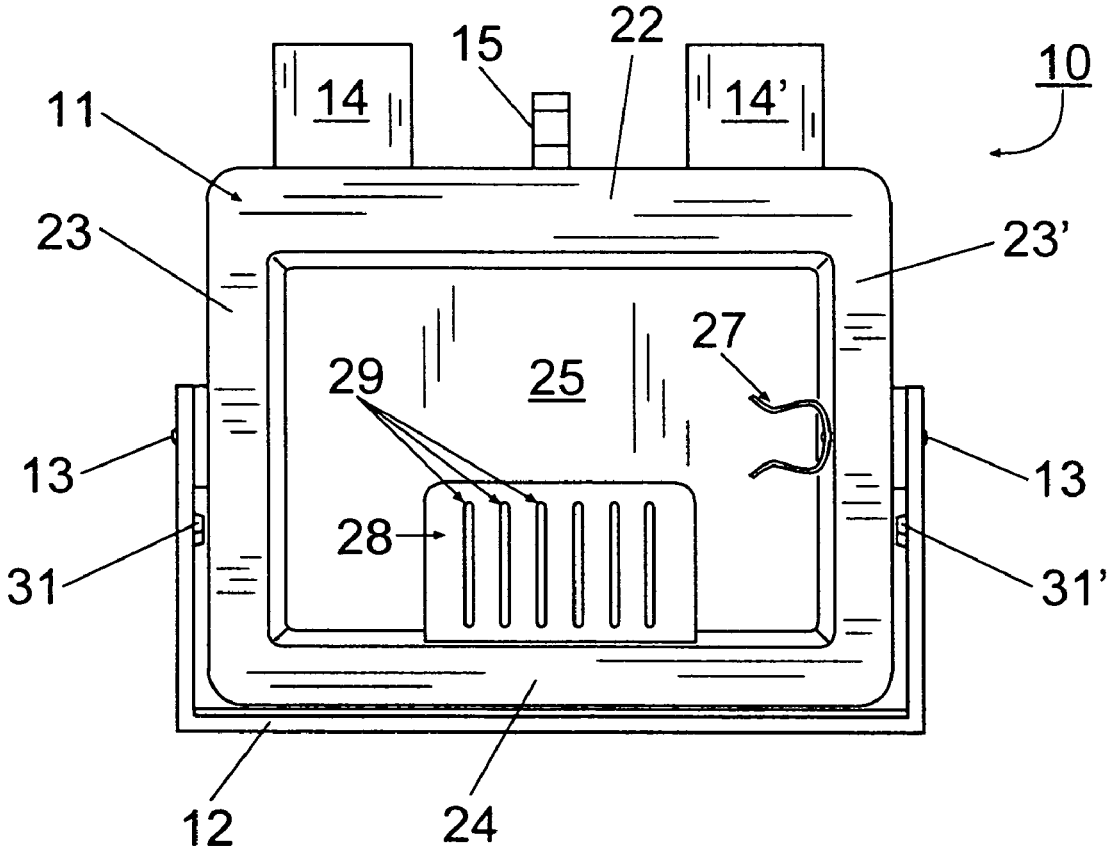
FIG. 2 demonstrates a top plan view of the container device as shown in FIG. 1 but removed from the ladder and without the lid.
Figure 3:
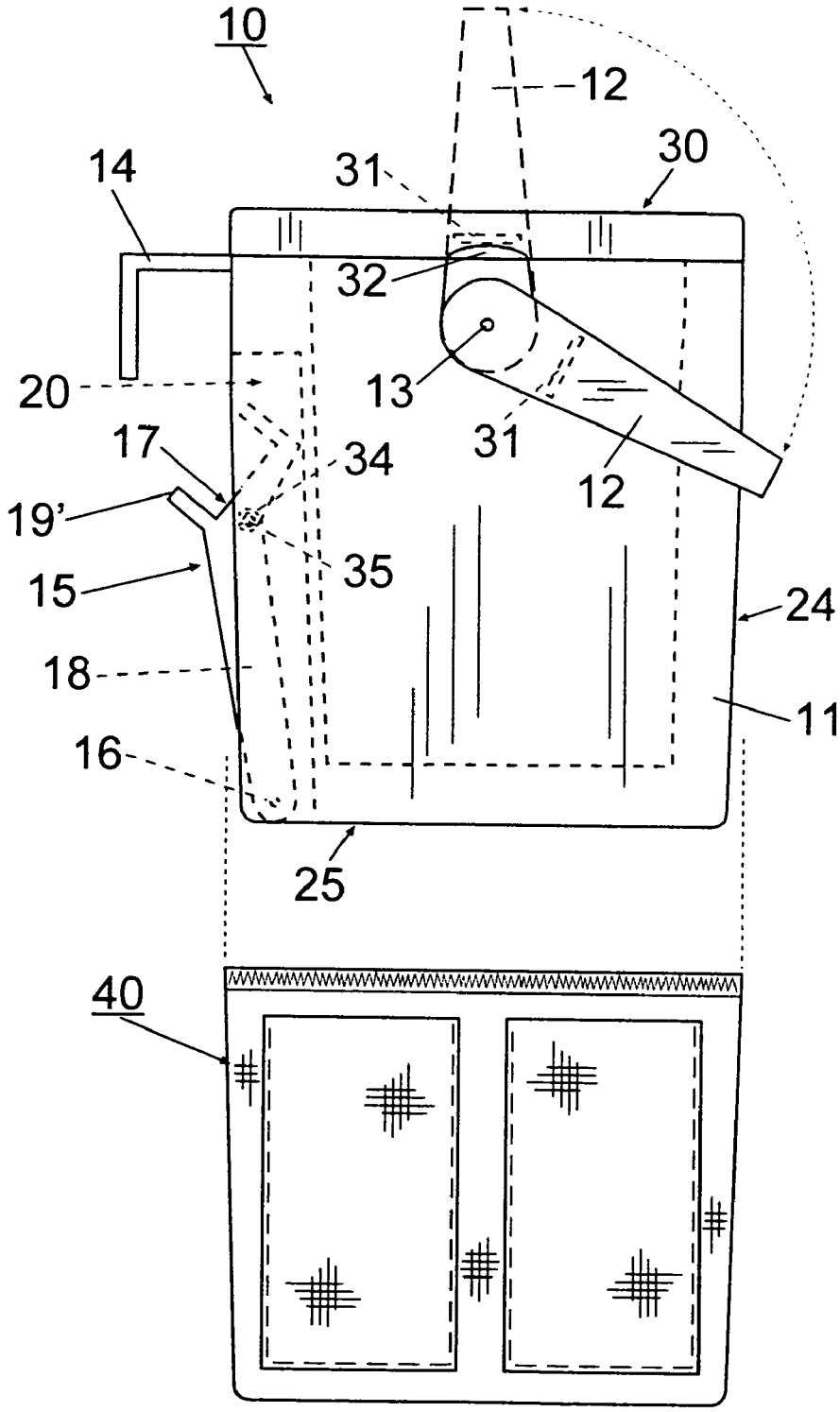
FIG. 3 illustrates a left side elevational view of the container device with the lid in place and the handle lowered, and with movement of the handle shown in dotted line fashion with the cover removed, the right side elevational view being a mirror image thereof.
Figure 4:
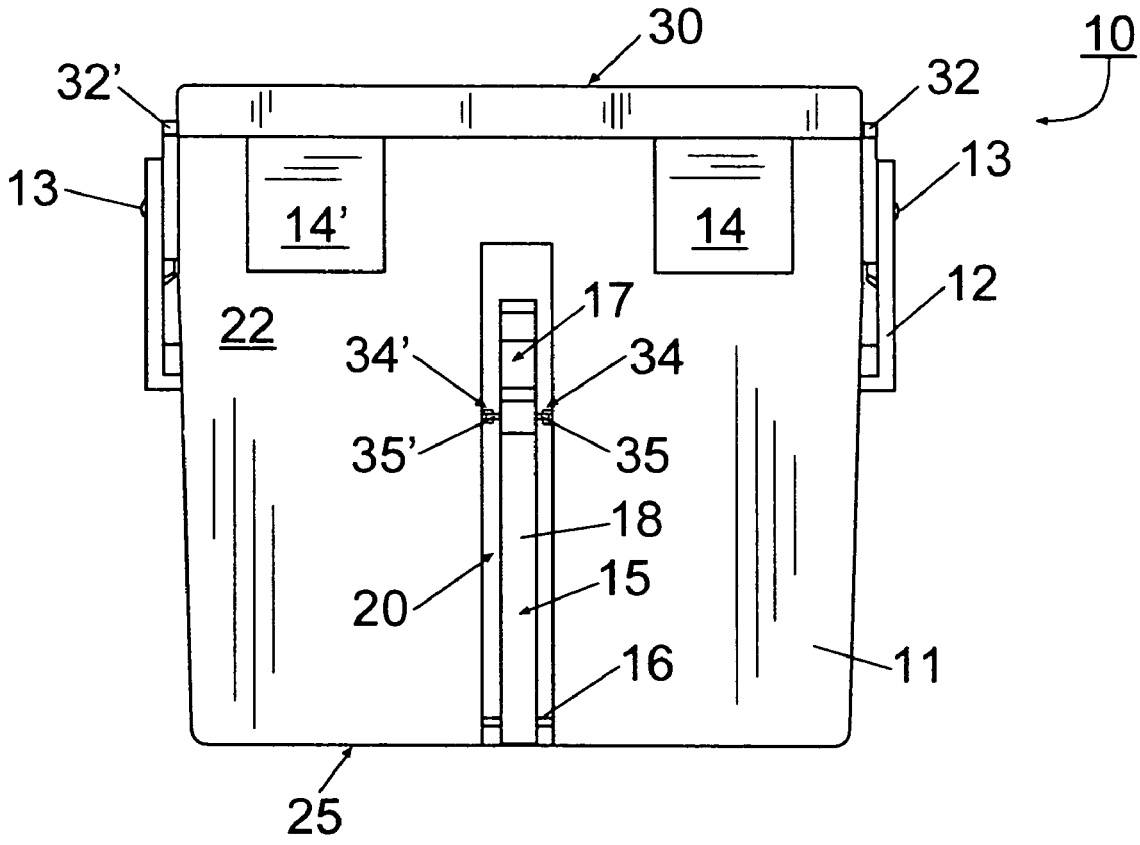
FIG. 4 pictures a rear elevational view of the container device as seen in FIG. 3.
Figure 5:
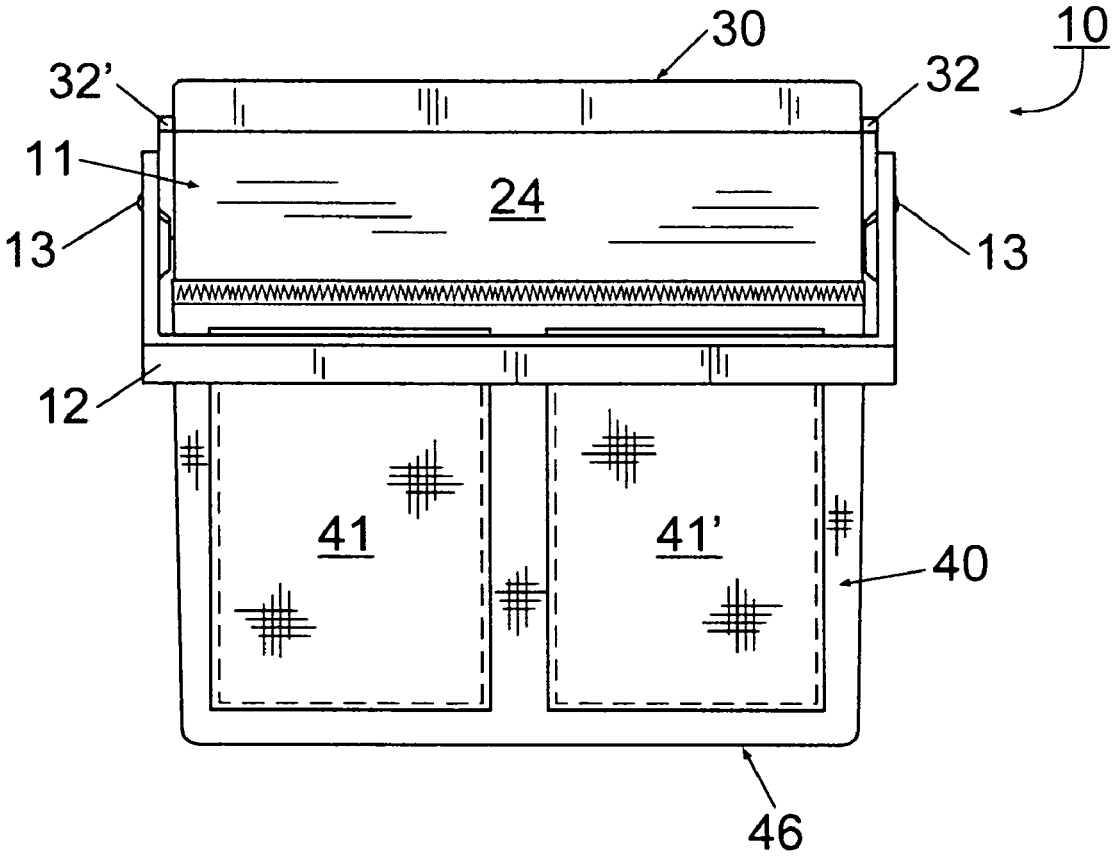
FIG. 5 features a front elevational view of the container device with the lid in place, the cover positioned thereon and the handle lowered.
Figure 6:
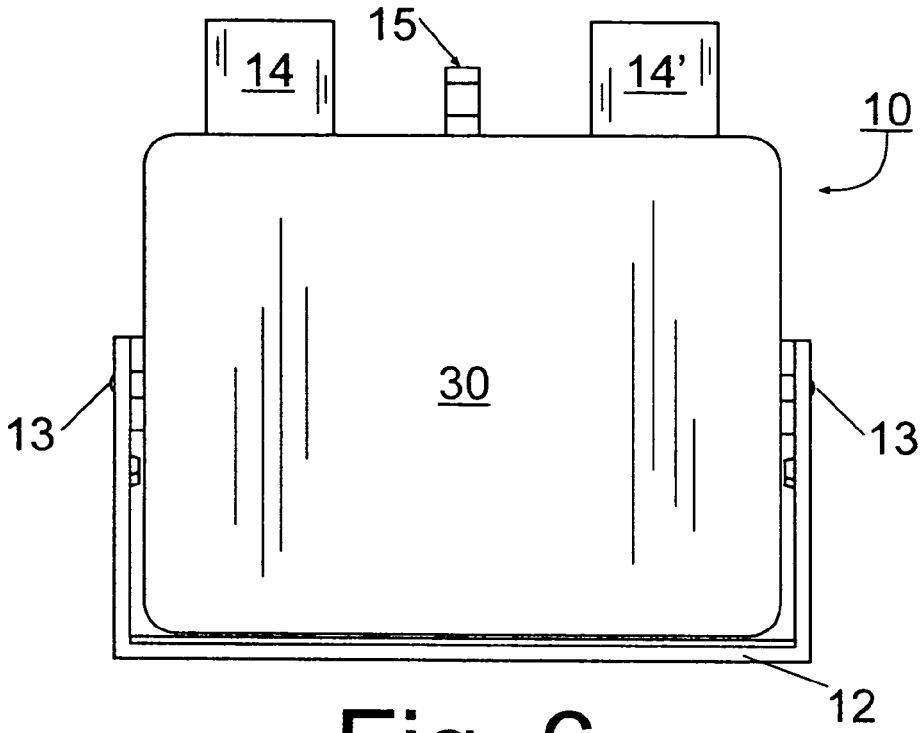
FIG. 6 shows a top plan view of the container device with the lid in place and the handle lowered.
Figure 7:
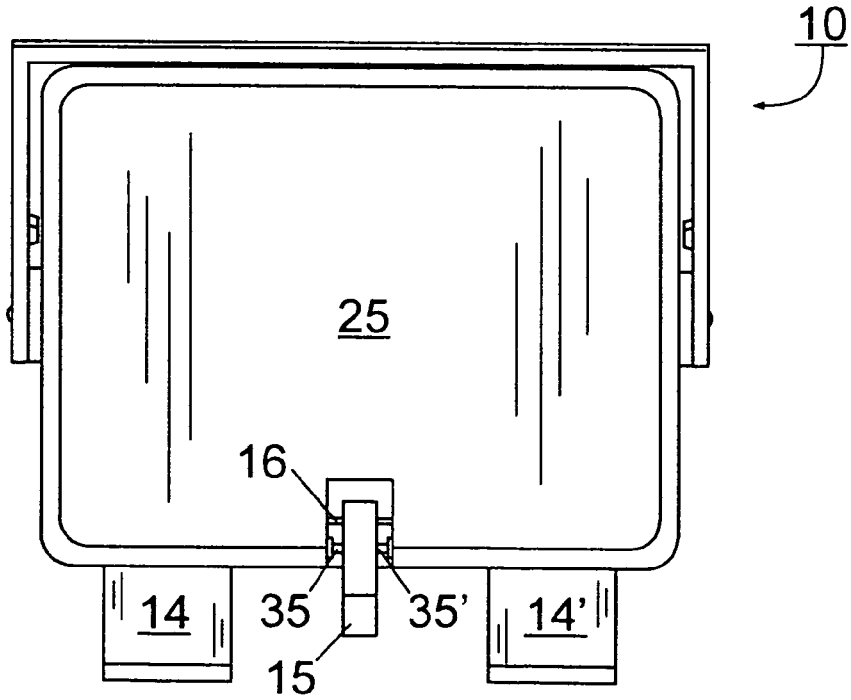
FIG. 7 depicts a bottom view thereof.
Figure 8:
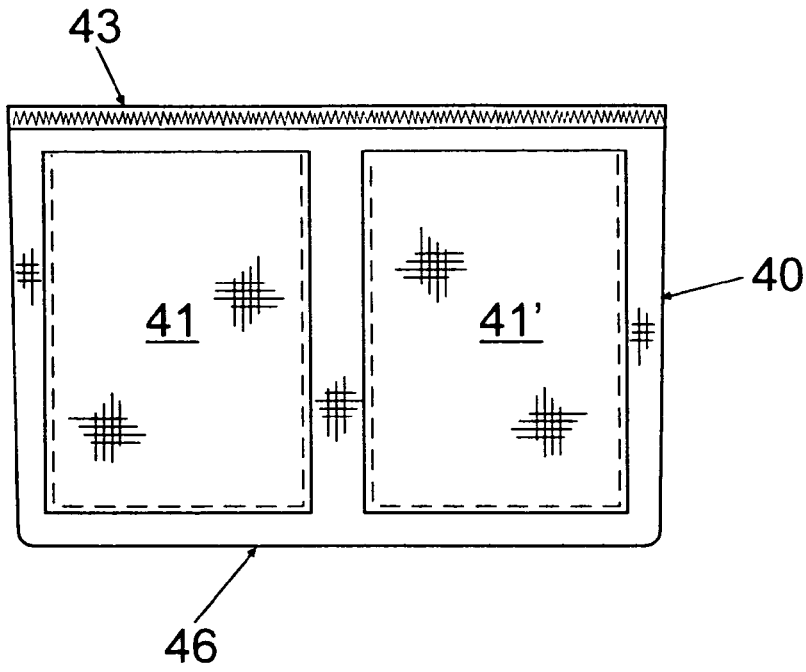
FIG. 8 shows a front elevational view of the cover as removed from the container device.

For a better understanding of the invention and its operation, turning now to the drawings, preferred container device 10 is shown in FIGS. 1-7 and is formed from a conventional plastic or other suitable materials. Device 10 includes substantially rectangular shaped receptacle 11 with pivotable handle 12 affixed thereto as shown for example in FIGS. 1, 2 and 3. In FIG. 2, handle 12 is seen substantially U-shaped and is joined to receptacle 11 by a pair of pivot axles 13, one on each side. L-shaped brackets 14, 14' seen in FIGS. 2, 3 and 4 are rigidly joined to the rear of receptacle 11 for releasably affixing container device 10 to a ladder rung such as ladder rung 51 of ladder 50 shown in fragmented, imaginary line fashion in FIG. 1. Brackets 14, 14' are immovably attached or integrally molded to receptacle 11 whereas pivotable bracket 15 is affixed to receptacle 11 by cylindrical spindle 16 as seen in FIGS. 1 and 4. Pivotable bracket 15 includes shank 18 and h-shaped head 17 for engaging ladder rung 52 as shown in FIG. 1. Pivotable bracket 15 helps to stabilize container device 10 between ladder rungs 51 and 52 when container device 10 is being used while painting.

As seen in FIGS. 3 and 4, pivotable bracket 15 is shown in a folded, closed posture contained within groove 20. Groove 20 is formed in the outer surface of rear wall 22 of container device 10 during molding. Stud channels 34, 34' (FIG. 4) are formed within groove 20 to tightly receive studs 35, 35' respectively, which are rigidly joined to head 17 to securely maintain pivotable bracket 15 in groove 20 as also seen in FIG. 1. Pivotable bracket head 17 includes fingers 19, 19' (FIG. 1) which engage ladder rung 52 as seen in FIG. 1 to assist in maintaining container device 10 in a level, stable posture when in use on a ladder such as ladder 50.

Wipe board 28 is shown in FIG. 2 attached to the inside of front wall 24 within receptacle 11 and includes a series of slots 29 to allow for example, a painter after dipping a paint brush (not shown) in paint (not shown) contained within receptacle 11 to wipe the paint brush across wipe board 28 and allow any excess paint therefrom to drain back into receptacle 11. As further seen in FIG. 2, receptacle 11 includes rear wall 22, side walls 23, 23', front wall 24 and bottom 25, and has a capacity for holding approximately one and a half gallons of paint therein, other sizes and capacities could likewise be manufactured. Brush clamp 27 also seen in FIG. 2 is made from a suitable spring steel wire and is affixed within receptacle 11 to side wall 23', with a means for attachment such as a bolt or screw (not seen), for supporting the handle of a standard paint brush. A painter can thus conveniently pour paint into receptacle 11 and can remove the paint brush (not shown) from clamp 27 when beginning to paint. While painting should the painter need to lay the paint brush down for a moment, the paint brush can be inserted and maintained in clamp 27.

In order to prevent any paint remaining in receptacle 11 from drying during periods of non-use, lid 30 as shown in FIGS. 1, 3, 4, 5 and 6 is provided. Once lid 30 is placed atop receptacle 11, handle 12 is then rotated as illustrated in imaginary line form in FIG. 3 to an upright position. During rotation, locking tabs 31, 31' (FIGS. 2 and 3) on handle 12 frictionally engage respectively, curved tab slides 32, 32' (FIGS. 3, 4 and 5) on lid 30 to secure and maintain lid 30 in an air tight manner atop container device 10. The locking action of respectively tabs 31, 31' with slides 32, 32' seals lid 30 to container device 10 to prevent drying or spillage of any paint contained within receptacle 11 during transport or storage.

Figure 9:
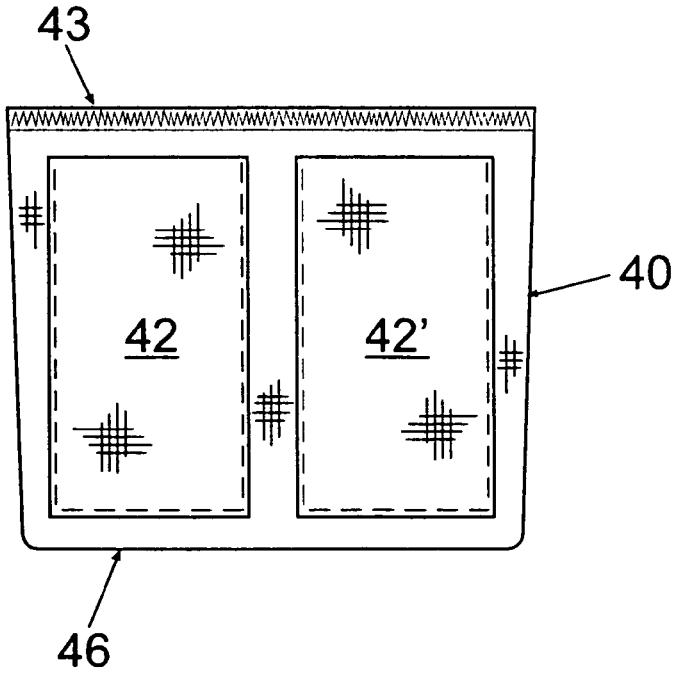
FIG. 9 depicts a left side elevational view of the cover as shown in FIG. 8, the right side elevational view being a mirror image thereof.
Figure 10:
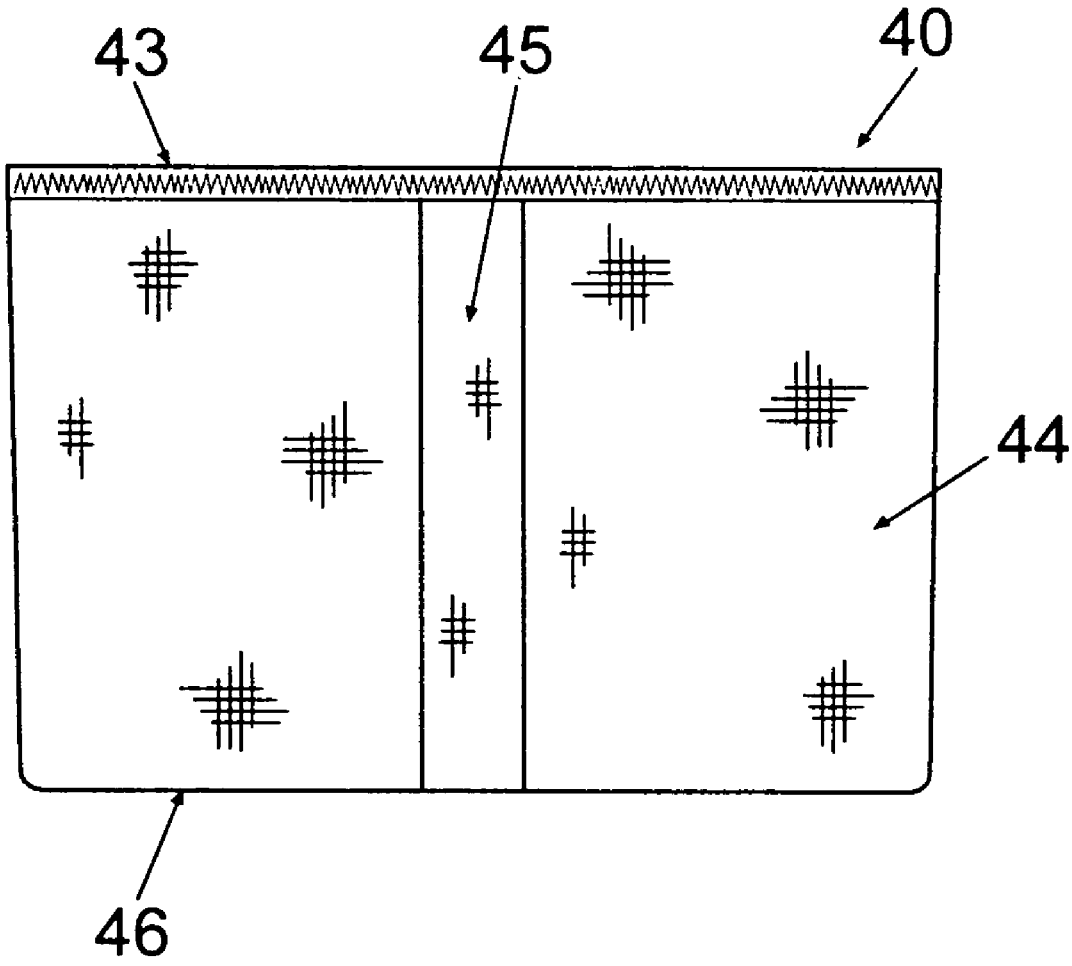
FIG. 10 shows a rear elevational view of the cover as shown in FIG. 8.

For convenience purposes, flexible cover 40 as seen in FIGS. 5, 8, 9 and 10 includes front pockets 41, 41' (FIGS. 5 and 8) and two (2) pairs of side pockets 42, 42' (only one pair of side pockets 42, 42' is shown in FIG. 9), one pair on each side of cover 40. Cover 40 is made from durable, flexible material such as a thin canvas and includes elastic band 43 to frictionally engage the outside of walls 22, 23, 23' and 24 of container device 10 to maintain cover 40 securely thereon. Pockets 41, 41', 42, 42', 42 and 42' allow placement of various painting accessories (not shown) such as putty knives, screwdrivers, rags or other tools in a location for easy access. Rear 44 of cover 40 includes opening 45 as seen in FIG. 10 for access and movement of pivotable bracket 15. Bottom 46 of cover 40 is sized to adequately fit bottom 25 of receptacle 11.

The illustrations and examples provided herein are for explanatory purposes and are not intended to limit the scope of the appended claims.

I claim:

1. A device for holding paint for releasable attachment to the rungs of a ladder, said device comprising a receptacle, a lid, said lid positioned on said receptacle to seal said receptacle, a first fixed bracket, said first fixed bracket attached to said receptacle to engage a ladder rung, a flexible cover, said cover surrounding said receptacle, and a pivotable bracket, said pivotable bracket attached to said receptacle, said pivotable bracket for attachment to a ladder rung, wherein said receptacle defines an outer bracket groove, and said pivotable bracket is mounted within said outer bracket groove.

2. The device of claim 1 further comprising a clamp, said clamp affixed to said receptacle for mounting a paint brush.

3. The device of claim 1 further comprising a wipe board, said wipe board attached within said receptacle.

* * * * *